United States Patent [19]

Birkenfeld

[11] Patent Number: 4,724,652

[45] Date of Patent: Feb. 16, 1988

[54] ARRANGEMENT FOR MANUFACTURING NON-PALLETIZED PACKAGING UNITS COMPLETELY COVERED WITH SHRINKING FOIL

[75] Inventor: Richard Birkenfeld, Beckum, Fed. Rep. of Germany

[73] Assignee: Möllers Maschinenfabrik GmbH, Fed. Rep. of Germany

[21] Appl. No.: 36,373

[22] Filed: Apr. 9, 1987

[30] Foreign Application Priority Data

Jun. 25, 1986 [DE] Fed. Rep. of Germany ..... 3621296

[51] Int. Cl.[4] ..... B65B 9/10; B65B 53/06

[52] U.S. Cl. ..... 53/170; 53/557; 53/567; 53/442

[58] Field of Search ..... 53/442, 170, 540, 557, 53/567

[56] References Cited

U.S. PATENT DOCUMENTS

| | | | |
|---|---|---|---|
| 4,060,957 | 12/1977 | Birkenfeld | 53/557 X |
| 4,258,533 | 3/1981 | Aka | 53/557 |
| 4,434,603 | 3/1984 | Beumer | 53/557 |
| 4,473,990 | 10/1984 | Thimon | 53/567 |
| 4,575,989 | 3/1986 | Hannen | 53/442 X |

FOREIGN PATENT DOCUMENTS

| | | | |
|---|---|---|---|
| 2743568 | 3/1979 | Fed. Rep. of Germany | 53/442 |
| 2916298 | 10/1980 | Fed. Rep. of Germany | 53/557 |

*Primary Examiner*—John Sipos

*Attorney, Agent, or Firm*—Toren, McGeady & Associates

[57] ABSTRACT

An arrangement for manufacturing non-pelletized packaging units which are completely surrounded with shrinking foil. The packaging units are formed by several layers of objects which are stacked on top of each other in such a way that at least two parallel recesses are formed into which support members of a lifting device can engage. The arrangement includes a single shrinking foil application device and a single shrinking device forming a combined arrangement and having a common conveyor and support track. Shaping tools of a shaping device are permanently assigned to an appropriate conveyor surface of a turning device. The shaping tools can be moved into position for shaping the shrinking foil in the recesses after a first shrinking foil has been applied and shrunk onto the stack. After turning the stack, the shaping tools are moved into a release position. The shaping tools can then again be moved into position for shaping the shrinking foil in the recesses after the stack has been returned to the combined arrangement and a second shrinking foil has been slid over the stack and shrunk onto the stack and the stack has then again been moved into the turning device. The shaping tools can then be moved into a release position, so that the stacks can be laterally moved away.

7 Claims, 4 Drawing Figures

ARRANGEMENT FOR MANUFACTURING NON-PALLETIZED PACKAGING UNITS COMPLETELY COVERED WITH SHRINKING FOIL

BACKGROUND OF THE INVENTION

1. Field of the Invention

The present invention relates to an arrangement for manufacturing non-palletized packaging units which are completely surrounded with shrinking foil. The packaging units are formed by several layers of objects which are stacked on top of each other.

2. Description of the Prior Art

In a method for manufacturing the packaging units described above, initially several layers of objects having the same surface area are stacked one on top of the other and then a special layer of objects is stacked on top of the other layers in such a way that at least two parallel recesses are formed into which support members of a lifting device later engage. A first layer of shrinking foil is then placed on the entire stack. Subsequently, the shrinking foil is shrunk onto the stack by the application of heat. The entire stack is then turned by 180°, so that the special layer with the recesses is placed at the bottom. A second layer of shrinking foil is then placed on the stack and shrunk onto the stack by the application of heat. The shrinking foil in the region of the recesses is formed to conform with the shape of the recesses prior to turning the stack and/or after shrinking the second layer of shrinking foil onto the stack.

An apparatus for carrying out the method described above includes a shrinking foil application device, a shrinking device, a turning device having two conveyor surfaces which can be moved against the stack from two opposite sides, and a single shaping device which is combined with the turning device. The shaping device serves to conform the shrinking foil to the shape of the recesses. The shaping device includes shaping tools which cooperate with one of the two conveyor surfaces of the turning device. The shaping tools can be moved into a shaping position prior to the turning of the stack and can be maintained in the shaping position during the turning of the stack.

In a known arrangement of this type, for example, from German Patent No. 27 43 568, the shaping tools in the turning device are formed by a two-piece, relatively complicated shaping frame. Before a stack is moved into the turning device, the shaping frame, together with a first shrinking foil attached to the shaping frame, is moved toward one of the two conveyor surfaces of the turning device. After the stack has been moved into the turning device, the shaping frame and the first shrinking foil are moved from the top into the recesses formed by the special layer of the stack as the two conveyor surfaces of the turning device are moved toward each other. After the stack has been turned, the shaping frame is moved out of the turning device together with the turned stack and is transported together with the stack to a second shrinking foil application device and a second shrinking device. Subsequently, the shaping frame is separated from the stack and returned into the turning device. This known arrangement is very useful for forming stacks which are stable and retain their shape. However, the arrangement is very complicated in its construction and requires a substantial amount of space.

In arrangements of the above-described type requiring a small output, it is known from German Patent No. 27 60 249 to reduce the structural requirements by mounting the turning device between a single shrinking foil application device and a single shrinking device. In this arrangement, the stack of objects merely is passed through the turning device without turning the stack after the first shrinking foil has been applied to the stack. Subsequently, the first shrinking foil is shrunk onto the stack in the shrinking device. The stack is then returned to the turning device, is turned in the turning device and is moved back to the shrinking foil application device, where the second shrinking foil is slid over the stack and, after again merely passing through the turning device, is transported into the shrinking device for shrinking on the second shrinking foil. However, for shaping the foil in the recesses, this known arrangement requires two additional shaping devices, i.e., a shaping device arranged in front of the shrinking device for shaping the shrinking foil in the recesses when the recesses are located at the top and another shaping device located after the shrinking device for shaping the shrinking foil in the recesses when these recesses are at the bottom after the stack has been turned.

It is, therefore, the primary object of the present invention to provide an apparatus for manufacturing non-pelletized packaging units surrounded completely with shrinking foil in which the space required for the arrangement is small and the structural requirements are reduced. This object is to be met particularly in an arrangement requiring relatively small output, similar to the arrangement disclosed in German Patent No. 27 60 249. Also, the packaging unit to be formed with the arrangement according to the invention is to be stable and is to retain its shape as much as possible, similar to the arrangement according to German Patent No. 27 43 568.

SUMMARY OF THE INVENTION

In accordance with the present invention, an arrangement of the above-described type includes a single shrinking foil application device and a single shrinking device forming a combined arrangement and having a common conveyor and support track. The shaping tools of the shaping device are permanently assigned to the appropriate conveyor surface of the subsequent turning device. By means of driving means arranged on the turning device, the shaping tool can be moved into position for shaping the shrinking foil in the recesses after the first shrinking foil has been applied and shrunk onto the stack. After the stack has been turned, the shaping tools are moved into a release position. The shaping tools can then again be moved into position for shaping the shrinking foil in the recesses after the stack has returned to the combined shrinking foil application and shrinking device and the second shrinking foil has been slid over the stack and shrunk onto the stack and the stack has then again been moved to the turning device. The shaping tools can then be moved into the released position, so that the stacks can be laterally transported away.

Compared to prior art arrangements, the arrangement according to the invention results in a substantially more compact overall structural length. Specifically, the structural length is reduced by half because, instead of six individual devices arranged one after the other, namely palletizing device, shrinking foil application device, turning device, top shaping device, shrinking device and bottom shaping device, in the arrangement according to the invention only three individual devices must be arranged one behind the other, namely palletizing device, combined shrinking foil application and shrinking device, and turning device with top and bottom shaping devices.

In addition, the travel time between the individual devices are substantially reduced. In addition, the times required for operating the individual devices are somewhat shorter, as will be described in more detail in the following.

Finally, even though the combined individual devices of the arrangement of the invention are more complicated and more expensive compared to prior art arrangements, the overall structural requirements are less because, in the combined shrinking foil application and shrinking device, one stand can be used in place of previously two machines and, in the combined turning and shaping device, one stand can be used in place of previously three machines. Moreover, the number of conveyor surfaces for the individual machines and the conveyor portions connecting the individual machines is smaller.

In accordance with a further advantageous development of the invention, the shaping tools are conveyor elements which are arranged in front of the beginning and behind the end of the corresponding conveyor surface of the turning device and between this conveyor surface and the preceding and subsequent conveyors, wherein the conveyor elements can each be moved into one of the recesses of the stack until making contact with the horizontal surface of the recess. The conveyor elements arranged on both sides of the conveyor surface has a length together with the conveyor surface which corresponds approximately to the length of the oppositely located conveyor surface, as already known in part from German Patent No. 28 39 089 directed to an arrangement for shaping the foil in the recesses of a stack located at the bottom of the stack.

Each of the conveyor elements described above may be a set of rollers. This is particularly useful for moving the stack into and out of the turning device when the recesses of the stack are located at the bottom.

However, each conveyor element may also be a conveyor belt or a multiple belt drive.

In accordance with another advantageous feature of the present invention, the movements of the conveyor elements are adjustable to the recesses of differently dimensioned packaging units or stacks.

Finally, the conveyor of the combined shrinking foil application device and shrinking device may be constructed so as to be raisable prior to the beginning of the shrinking procedure and to be lowerable after the shrinking foil has been shrunk onto the lowermost portion of the stack, so that the lowermost portion of the stack can be easily reached by a burner or the like for shrinking the foil which is arranged on a common raiseable and lowerable frame above the elements which apply the shrinking foil.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
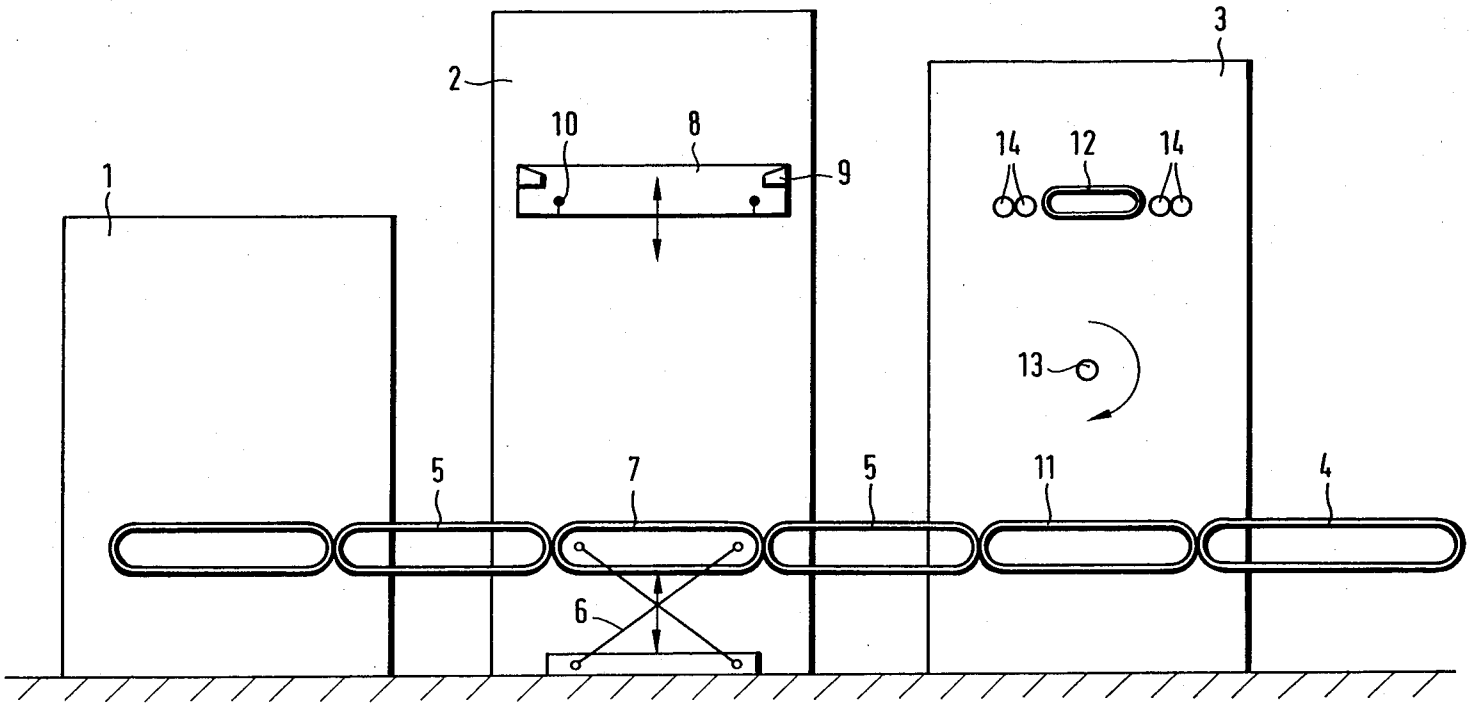
FIG. 1 is a schematic side elevational view of the overall arrangement according to the present invention.

The overall arrangement illustrated in FIG. 1 includes a conventional pelletizing device 1, an also essentially conventional shrinking foil application and shrinking device 2, and a nozzle turning device 3 constructed in accordance with the present invention. The arrangement further includes a discharge conveyor 4 following the turning device 3 and an intermediate conveyor 5 arranged between pelletizing device 1 and combined shrinking foil application and shrinking device 2, and another intermediate conveyor 5 arranged between device 2 and the turning device 3.

Combination device 2 includes a conveyor and support track 7 which can be raised and lowered by means of a scissors-type lifting device 6. Device 2 further includes a frame 8 which can be raised and lowered by means of chains, not shown. Frame 8 includes at its top a circumferentially extending burner 9 or the like for shrinking the foil and at its bottom elements 10 which are constructed as gripping fingers for applying a hood of shrinking foil onto a stack placed on the conveyor and support track 7. For clarity's sake, the stack is not illustrated in FIG. 1. However, in FIG. 2, the stack is denoted with reference character S.

The turning device 3 has two conveyor surfaces 11 and 12 which can be moved toward each other. Together with guides and drive means facilitating the relative mobility of the conveyor surfaces 11 and 12, the latter can be rotated about an axis 13, as has been known in the past.

The novel fearture of turning device 3 is that one of the two conveyor surfaces, i.e., the conveyor surface 12 shown at the top in FIG. 1, has conveyor elements 14 each formed by a set of rollers and arranged on both sides of conveyor surface 12. The conveyor elements 14 are constructed so as to be movable together by means of driving means, not shown, relative to the conveyor surface 12 toward the central axis 13. The length of the conveyor surface 12 together with the two conveyor elements 14 essentially is the same as the length of the conveyor surface 11 at the bottom in FIG. 1.

Figure 2:
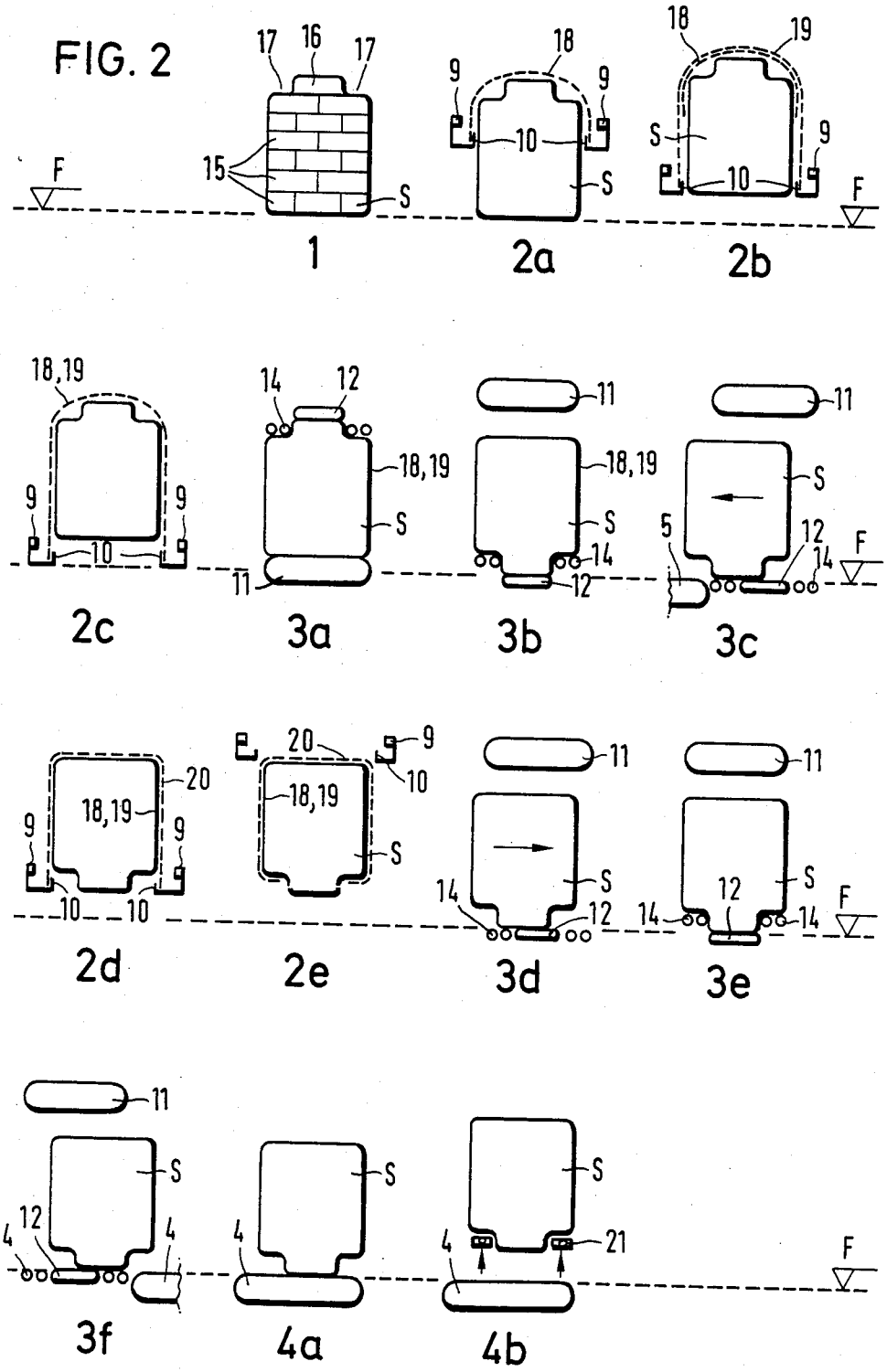
FIG. 2 is a schematic diagram of the operations performed by the arrangement of FIG. 1.

The manner of operation of the arrangement according to the invention illustrated in FIG. 1 will be explained in more detail below with particular reference to FIG. 2. In FIG. 2, the reference numerals of the individual devices 1, 2, 3 or 4 are indicated below so as to indicate the individual device in which the stack is positioned at a given moment. Reference letters a, b, etc. are added to these reference numerals to identify the various stages to which the stack S is subjected in the respective devices. The conveying plane is indicated by a broken line and is denoted with reference character F.

In the first stage illustrated in FIG. 2, a stack S is formed in pelletizing device 1. Stack S is composed of a number of normal layers 15 and an upper special layer 16 having laterally formed recesses 17. The layers 15 and 16 are formed in accordance with a certain packing pattern.

After leaving the pelletizing device 1, the stack S is moved by intermediate conveyor 5 into the combination device 2. In device 2, the stack is initially covered with a short shrinking foil hood 18, as indicated at 2*a*. Subsequently, a long first shrinking foil hood 19 is slid over stack S and the conveyor and the support 7 of the combination device 2 is raised, as shown at 2*b*. The lowermost portion of the stack is now in such a position relative to burner 9 of combination device 2 that shrinking of the foil can be performed efficiently in the lower portion of the stack, as shown at 2c. Subsequently, common frame 8 is moved upwardly and the foil of the two hoods 18 and 19 is tightly shrunk onto the stack, not illustrated in detail. The complete shrinking of the two hoods 18 and 19 may also be performed from top to bottom after an initial shrinking has been effected in the lower region of the stack, so that air trapped within the stack can escape as much as possible.

The conveyor and support track 7 of combination device 2 is then again lowered and the stack S is moved by means of intermediate conveyor 5 onto the conveyor surface 11 of turning device 3. The conveyor surfaces 11 and 12 are moved toward each other and then the two conveyor elements 14 arranged on both sides of the shorter upper surface 12 are lowered into the recesses 17, as shown at 3*a*, in order to clearly shape the foil in these recesses.

Stack S is then turned by 180°, as shown at 3*b*, and is laterally turned by means of intermediate conveyor 5 onto the conveyor and support track 7 of combination device 2, as shown at 3c. A second or opposing hood 20 is now slid over the stack in combination device 2 as shown at 2*d* and, subsequently, the second hood 20 is shrunk onto the stack, as shown at 2*e*.

The stack S is then again moved by means of intermediate conveyor 5 into the turning device 3 and is placed on the shorter conveyor surface 12 which is still located at the bottom. The conveyor elements 14 are then moved into recesses 17 in order to shape the foil to the recesses, as illustrated at 3*d* and 3*e*.

After the shrinking foil has sufficiently cooled, the stack S which is now completely surrounded with shrunk-on foil is laterally moved onto the discharge converyor 4, as shown at 4*f* and 4*a*. Finally, the finished stack is removed by means of lifting members 21, for example, the tines of a forklift, as illustrated at 4*b*.

Figure 3:
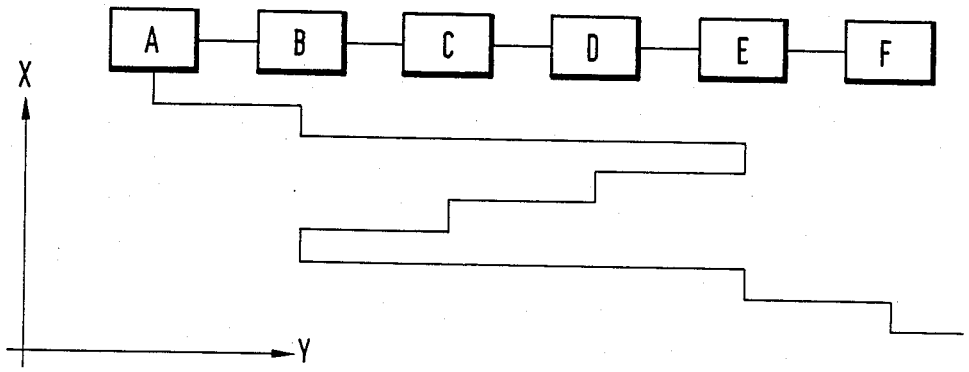
FIG. 3 is a schematic diagram of the operation times and travel times of the arrangement known from German Patent No. 27 60 249.
Figure 4:
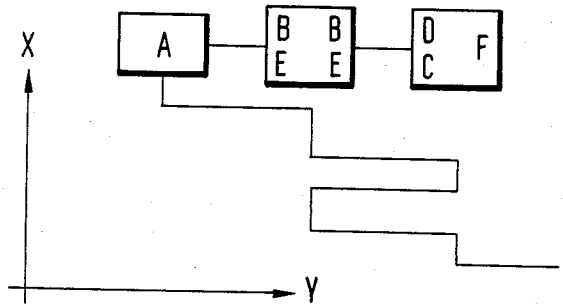
FIG. 4 is a schematic diagram of the operation times and travel times of the arrangement according to the invention.

In order to illustrate the advantages of the arrangement according to the present invention as compared to prior art arrangements, the operation times and travel times required in the known arrangement according to German Patent No. 27 60 249 are shown in FIG. 3 and those of the arrangement according to the invention are shown in FIG. 4. The travel times are schematically illustrated over coordinate axis y and the operation times are schematically illustrated over coordinate axis x. The individual operation steps are denoted by letters as follows:

Palletizing: A
Application of shrinking foil: B
Turning: C
Top foil shaping: D
Shrinking: E
Bottom foil shaping: F The operation steps are each symbolically placed in rectangles which correspond to the individual devices of the arrangement.

A comparison between FIGS. 3 and 4 shows primarily that the travel times are substantially reduced in the arrangement according to the invention as compared to the prior art arrangement. In fact, the reduction in travel times is almost three times that of the prior art arrangement. In addition, the operation times are also slightly reduced.

The above-described arrangement can be modified without leaving the basic concept of the present invention. For example, the combined turning and foil shaping device according to the invention can also be advantageously utilized in connection with differently constructed shrink foil application and shrinking devices. For example, the turning and foil shaping device can be used in a method in which, instead of applying a second shrinking foil hood, after turning the stack a flat foil is placed and shrunk onto the turned stack which flat foil more or less deeply hangs from the side surfaces of the stack. This procedure could be performed in an appropriately constructed combined shrinking foil application and shrinking device.

The combined turning and foil shaping device according to the invention could also be arranged along a so-called line, i.e., combined turning and foil shaping devices are arranged in front of and behind a combined shrinking foil application and shrinking device. However, this arrangement would not fully utilize the advantages according to the present invention. Similarly, separate shrinking foil application and shrinking devices could be arranged in front of and behind the combined turning and foil shaping device. However, this would utilize the advantages of the invention even less.

Finally, in the turning device each of the two conveyor surfaces which are movable toward each other could be provided with conveyor elements which are movable into the recesses of the special layer of the stack. As a result, it would be unnecessary to turn the turning device in order to be able to receive the next stack after the preceding stack has left the turning device with fully shrunk-on shrinking foil. However, generally enough time will be available to turn the turning device during the application and shrinking of the shrinking foil in the preceding combined shrinking foil application and shrinking device.

While the specific embodiment of the invention has been shown and described in detail to illustrate the application of the inventive principles, it will be understood that the the invention may be embodied otherwise without departing from such principles.

I claim:

1. An arrangement for manufacturing non-palletized packaging units completely covered with shrinking foil, wherein the packaging units include several layers of objects having the same surface area stacked one on top of the other and a special layer of objects stacked on top of the other layers so that at least two parallel recesses are formed by the special layer, comprising a shrinking foil application device for placing shrinking foil over the packaging unit, a shrinking device for shrinking the foil onto the packaging unit by the application of heat, a turning device for turning the packaging unit by 180°, the turning device including two conveyor surfaces movable toward each other, a shaping device for conforming the shrinking foil to the shape of the recesses, the shaping device including shaping tools cooperating with one of the two conveyor surfaces of the turning device, the shaping tools being movable into a shaping position prior to the turning of the packaging unit and maintainable in the shaping position during the turning of the packaging unit, wherein the improvement comprises that the shrinking foil application device and the shrinking device are combined in a combined device, the combined device including a common conveyor and support track for the packaging unit, the shaping tools being permanently assigned to one of the conveyor surfaces of the turning device, means for returning the packaging unit into the combined device after turning the unit, driving means arranged on the turning device for moving the shaping tools into a first shaping position in the recesses after a first shrinking foil has been applied and shrunk onto the packaging units into a first release position after the packaging unit has been turned by the turning device into a second shaping position after the packaging unit has been returned into the combined device and a second shrinking foil has been placed over and shrunk onto the packaging unit and the packaging unit has again been returned to the turning device, and into a second release position so that the packaging unit can be moved away laterally.

2. The arrangement according to claim 1, wherein the shaping tools are conveyor surfaces arranged in front of and behind the conveyor surface of the turning device assigned thereto, wherein the shaping tools are movable into the recesses of the packaging unit until they make contact with the horizontal surfaces of the recesses, and wherein the length of the shaping tools together with the associated conveyor surface is equal to the length of the oppositely located conveyor surface.

3. The arrangement according to claim 2, wherein each shaping tool is a set of rollers.

4. The arrangement according to claim 2, wherein each shaping tool is a conveyor belt.

5. The arrangement according to claim 2, wherein each shaping tool is a multiple belt drive.

6. The arrangement according to claim 2, wherein the movements of the shaping tools are adjustable to recesses of differently sized packaging units.

7. The arrangement according to claim 1, wherein the conveyor and support track of the combined device is movable into a raised position at the beginning of the shrinking procedure and into a lowered position after the shrinking foil has been shrunk onto the lowermost portion of the packaging unit.

* * * * *